United States Patent [19]

Wokas

[11] 4,003,182

[45] Jan. 18, 1977

[54] BUILDING CONSTRUCTION

[76] Inventor: Albert L. Wokas, 22245 Thorofare, Grosse Ile, Mich. 48138

[22] Filed: Dec. 19, 1974

[21] Appl. No.: 534,319

Related U.S. Application Data

[60] Division of Ser. No. 287,883, Sept. 11, 1972, Pat. No. 3,855,743, which is a continuation of Ser. No. 80,891, Oct. 15, 1970, abandoned.

[52] U.S. Cl. ..... 52/745

[51] Int. Cl.[2] ..... E04B 1/00

[58] Field of Search ..... 52/236, 79, 745, 185, 52/220, 34, 35, 221

[56] References Cited

UNITED STATES PATENTS

| | | | |
|---|---|---|---|
| 2,168,725 | 8/1939 | Whelan | 52/220 |
| 3,162,863 | 12/1964 | Wokas | 52/79 |
| 3,228,154 | 1/1966 | Mulitz | 52/185 |
| 3,396,502 | 8/1968 | Contevita | 52/79 |
| 3,540,173 | 11/1970 | Johnides | 52/79 |
| 3,724,141 | 4/1973 | Kelleher | 52/79 |

FOREIGN PATENTS OR APPLICATIONS

| | | | |
|---|---|---|---|
| 1,425,370 | 0000 | France | 52/79 |
| 375,300 | 2/1964 | Italy | 52/34 |

*Primary Examiner*—John E. Murtagh
*Attorney, Agent, or Firm*—Harness, Dickey & Pierce

[57] ABSTRACT

The disclosure reveals an inside-out method of building construction wherein factory built room forming boxes are first set in place on a foundation and thereafter the structure is built around the boxes as a core.

1 Claim, 11 Drawing Figures

BUILDING CONSTRUCTION

RELATED APPLICATIONS

This is a division of my application Ser. No. 287,883 filed Sept. 11, 1972 which now U.S. Pat. No. 3,855,743, in turn is a continuation of my application Ser. No. 80,891 filed Oct. 15, 1970, now abandoned.

BRIEF SUMMARY OF THE INVENTION

It is the purpose of the invention to improve building construction, especially multi-unit dwellings, by using mass produced building components.

In accordance with the invention, those parts of a dwelling which are most difficult, time-consuming, and expensive to construct on a job site, such as bathrooms, kitchens, utility rooms, stairwells, and closets, are componentized and pre-built separately in a factory where all the quality and cost advantages of mass production can be obtained. These are then shipped in the form of boxes to the job site where they are set in place on a foundation to provide the nucleus of a desired floor plan. Thereafter, the rest of the dwelling is built around the boxes as a core.

DESCRIPTION OF THE INVENTION

Figures 1, 2, 3:
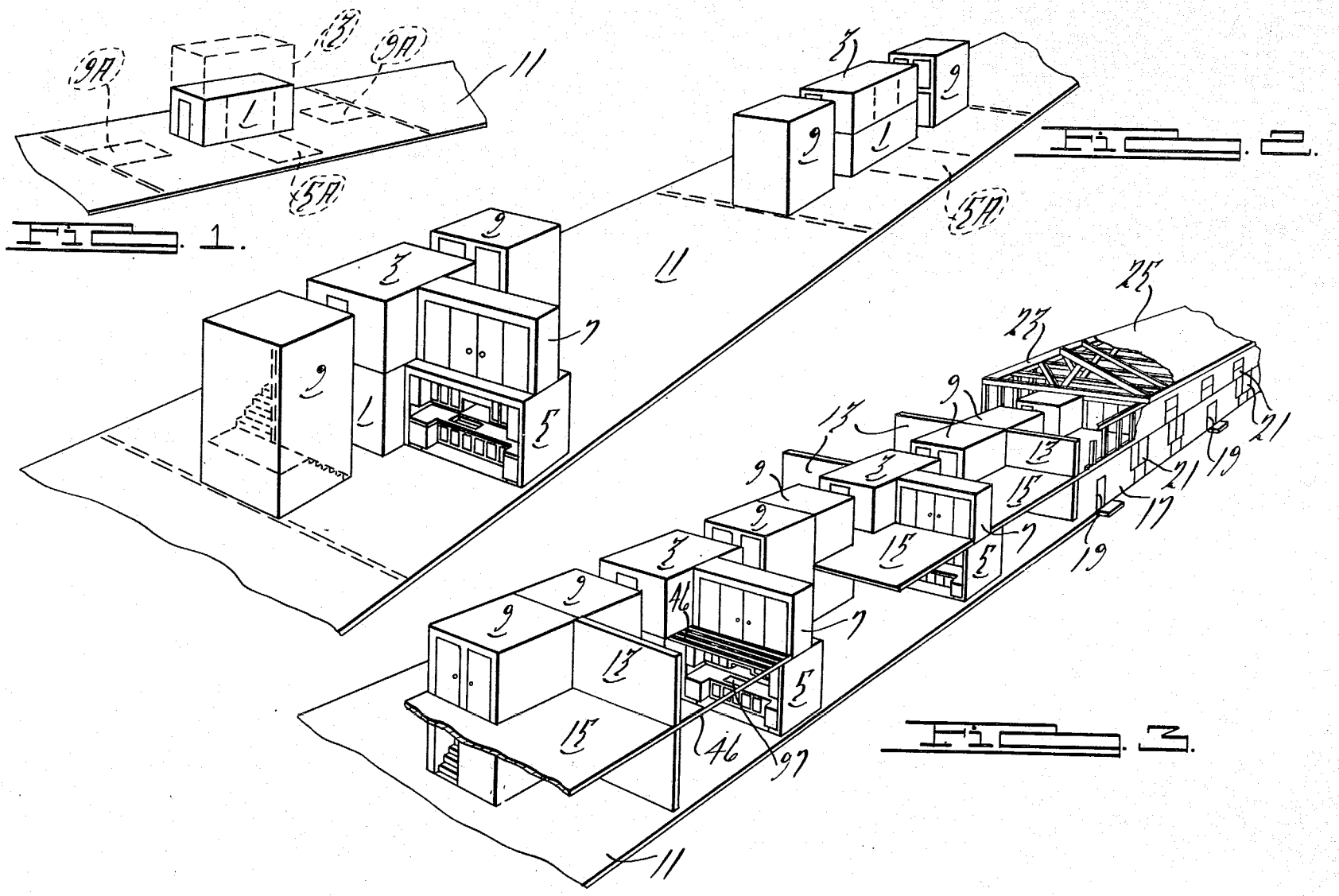
FIG. 1 is a schematic perspective view showing the beginning of construction using the component building system of this invention.
FIG. 2 is a view similar to FIG. 1 but showing a more advanced stage of construction.
FIG. 3 is a view similar to FIGS. 1 and 2 but showing a still more advanced stage of construction.

Referring to FIG. 3, this invention concerns itself with a method of construction using a utility room component 1, a full bath component 3, a kitchen component 5, a closet component 7, and a stairwell component 9 with built in closet space. As illustrated, the components 1, 5, and 9 are laid directly on a foundation 11 which may be a poured slab, the floor or joists over a basement, etc. The numerals 5A and 9A in FIGS. 1 and 2 indicate the spaces on which components 5 and 9 will be placed.

Figures 4, 5, 6:
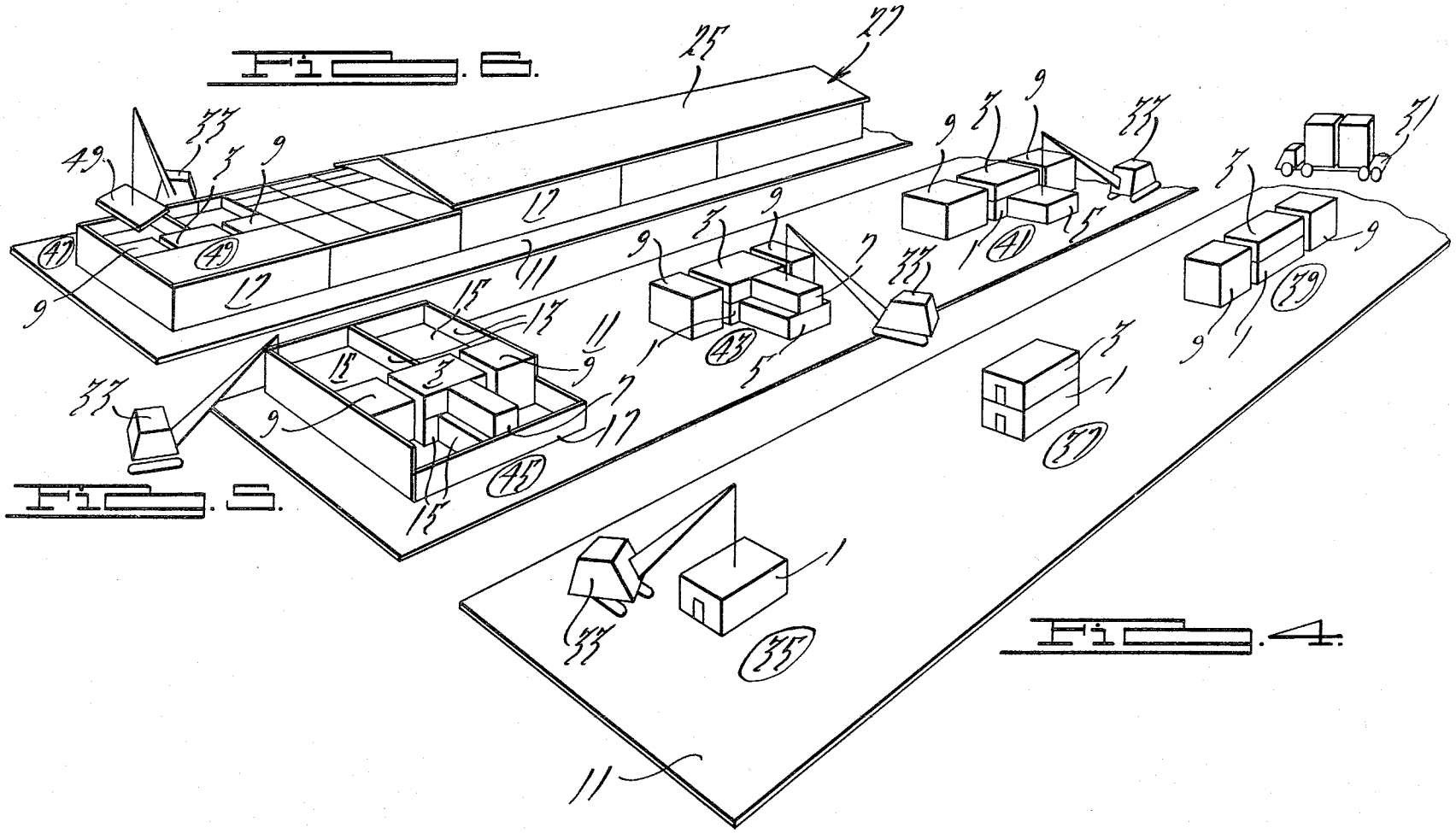
FIG. 4 is a schematic perspective view (in form of a modified flow diagram) showing placement of components in position.
FIG. 5 is a view similar to FIG. 4 showing a more advanced stage of construction.
FIG. 6 is a view similar to FIGS. 4 and 5 showing a still more advanced stage of construction.
Figure 7:
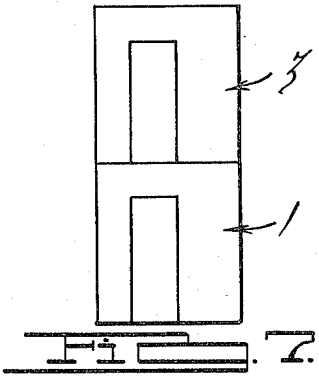
FIG. 7 is a side elevation of a double bathroom component stacked on a double utility room component.

Interior walls 13 and floors 15, exterior walls 17 (which may be separate for lower and upper levels) having doors 19 and windows 21, roof trusses 23, and roofing 25 all combine with the components to produce a multi-family town-house construction 27 as is apparent from FIG. 3 and as shown with details omitted in FIG. 6.

The sequence of construction is seen best in FIGS. 4 to 6 wherein the slab 11 is enlarged to facilitate illustration. First, an order is placed for factory construction of a suitable number of the components 1, 3, 5, 7, and 9 (or as many of them as are to be employed in the structure) and the foundation or slab 11 is prepared. When the slab is ready, the components are delivered to the job site by truck 31 and they may be stored or immediately set in place by a crane 33.

The first step in the installation of the components is shown in FIG. 4 at 35 where the utility room 1 is put in place by crane 33. The second step is shown at position 37 where a bathroom is set on top of the utility room component 1. A third step is shown at position 39 where the stairwell components 9 are set in place. The fourth step is shown in FIG. 5 at position 41 where the crane 33 is positioning the kitchen component 5. The fifth step is shown at position 43 where the crane 33 is setting the closet component 7 on the top of the kitchen component 5.

When step five (position 43) is reached, the components 1, 3, 5, 7, and 9 form an inside core for an adjoining pair of apartments so that construction can then proceed outwardly and the contractor has his choice of conventional "stick" building or of using pre-built floor, ceiling, and wall panels, or a combination of both. Thus, at position 45 lower and upper exterior pre-built walls 17 have been set in place and pre-built wall panels 13 and floor panels 15 are being put in place by crane 33. Floor joists 46 in FIG. 3 illustrate stick building at the second room, the joists being mounted on gussets (not shown) on box 3 and laid on top of box 5. At position 47 in FIG. 6 ceiling panels 49 are being set in place by crane 33 and the rest of FIG. 6 illustrates schematically completion of the town-house structure by setting of the roof trusses and roof panels 25.

Figure 10:
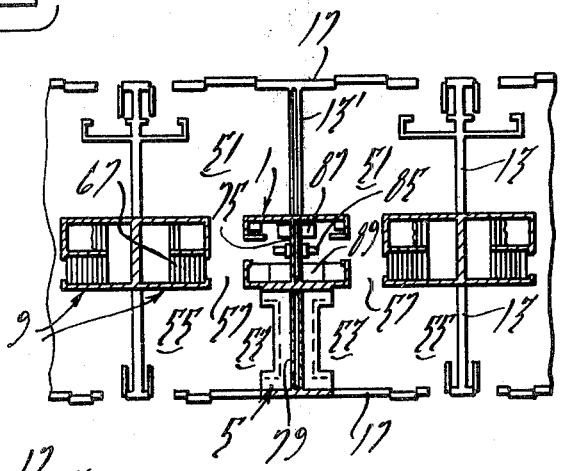
FIG. 10 is a typical floor plan for the first floor.
Figure 11:
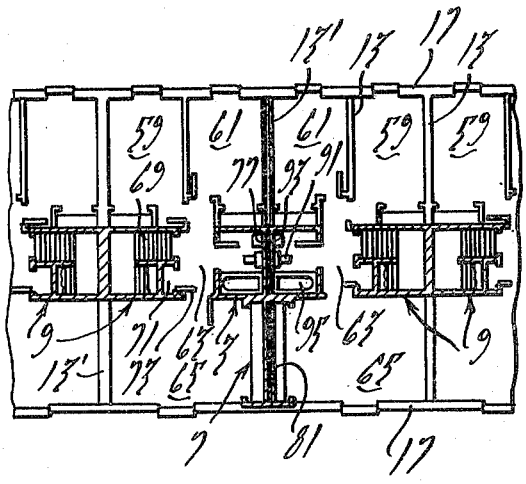
FIG. 11 is a typical floor plan for the second floor.

FIGS. 10 and 11 show the floor plan for the lower and upper levels that is obtained with the components and construction already described. The sectioned areas in these figures indicate parts of the components 1, 3, 5, 7, and 9. In FIG. 10, on the lower level there is a living room 51, a kitchen area 53, a dining area 55, and a hall 57 connecting the living room 51 with areas 53 and 55. In FIG. 11, on the upper level, there are two front bedrooms 59 and 61 connecting with a hall 63 that also connects with a master bedroom 65.

Components 1, 3, and 5 are preferably constructed in accordance with U.S. Pat. No. 3,162,863 and, thus, each comprises a self-sustaining box with a floor, roof, and sidewalls. Components 7 and 9 are made in this way also so that they can be factory-built, shipped to the site, and installed without on-the-job workmanship. The stairwell component 9 is somewhat different from the remaining components in that there is a separate one for each apartment (to keep it to a size that can be trucked) and in that it is two levels high. The stairwell component is preferably used as the bench mark or chalk line to establish the constant for all floor lines and ceiling lines in each apartment, thereby allowing all other wall systems, both interior and exterior, to be factory built, if desired, and set on the job with only minor adjustments. The stairwell component includes lower and upper stair sections 67 and 69 which open, respectively, into halls 57 and 63. The extra space in the box is used to provide at least one closet space, such as full size upper level closet 71 which is closed by door 73. All parts, including hung door 73, are built and installed at the factory. If deemed necessary, the box 9 (as well as the other components) may be covered with a weatherproof covering such as sheet plastic to protect it from the elements during shipping and before actual installation on the site.

In accordance with U.S. Pat. No. 3,162,863, the box components 1, 3, 5, and 7 are double or twin back-to-back units so that one half is used in each of adjacent but separate apartments and each has a hollow central wall (walls 75, 77, 79, and 81, respectively) which is common to two adjacent apartments and which houses all mechanical, electrical, plumbing, heating, and ventilating equipment and lines (generally indicated by reference numeral 83) that are required. The hollow sidewalls of the respective components are vertically and horizontally aligned so that the service lines can be run vertically between the two levels and horizontally between adjacent boxes. These equipment and lines preferably exit through access openings in the vertical sidewalls of the boxes, rather than through the slab floor 11, as pointed out in U.S. Pat. No. 3,162,863 and accordingly, center wall mounted or center wall adjacent plumbing fixtures are used in components 1 and 5 and preferably in upper component 3. Thus, in the utility box 1, the toilet 85 and wash basin 87 are mounted on the center wall 75 and the washer 89 adjacent the center wall; in bathroom 3, the toilet 91 and wash basin 93 are mounted on the center wall 77 and the bathtub and shower 95 has the inlet end against that wall; and in the kitchen unit 5 the sink 97 and other equipment requiring service are preferably mounted on center wall 79. The center wall 81 for closet unit 7 is preferably hollow also to permit passage, if desired, of lines from the bath unit 3 to the exterior of the building though it is preferable that the lines for unit 3 run down into the center wall for unit 1; and the aligned inner wall 13' may also be hollow for the same reason, if desired, as well as to provide improved sound insulation between adjacent apartments.

Figure 8:
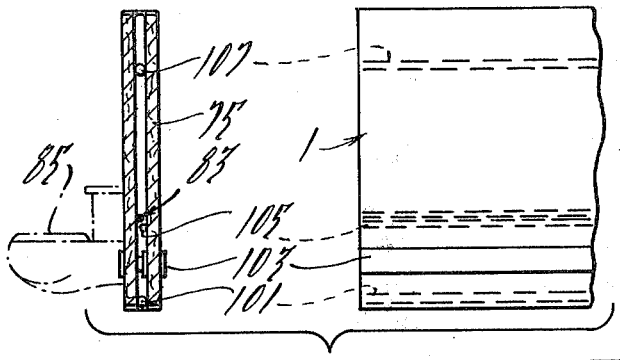
FIG. 8 shows the hollow center wall of a bath, utility room, or kitchen component as per U.S. Pat. No. 3,162,863.
Figure 9:
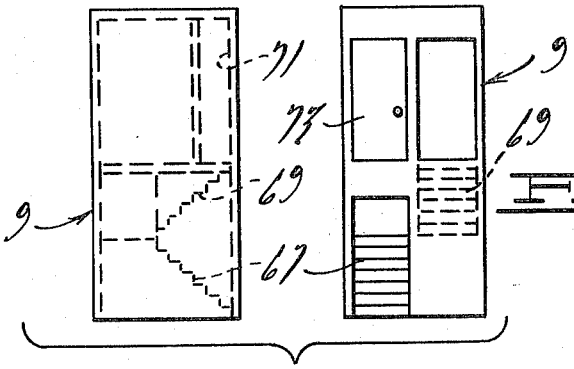
FIG. 9 shows side elevations of a stairwell component.

FIG. 8 illustrates the utility services 83 in the hollow center wall. These may include the sanitary line 101, the heat chase 103, hot and cold water lines 105, and an electrical conduit 107. The hook-ups of lines 83 to outside service is made at an appropriate point or points in the assembly of the structure when all lines are accessible. For example, some outside hook-ups may be made at position 43 before the pre-built walls, floors, and ceilings are installed.

In order to obtain the maximum advantage of the present construction method it is desirable that everything, mirrors, cupboards, light fixtures, wall paper, tile, fans, soap trays, carpeting, coat hooks, wiring and outlets, paper holders, etc., be installed in the box components at the factory where they are built so that only hook-up and touch-up for transit damage (if any) are required at the site. The system, however, is flexible and parts of the units defined by components 1, 3, 5, 7, and 9 can be built on the site if desired.

It is obvious that the box components can be arranged in a variety of different ways to obtain a variety of different floor plans, both single and multi-level, and widely different areas of the same floor plan and that the multi-component-core concept of this invention is very flexible so that it can be used in townhouses, apartments, condominiums, high rises, etc. By making the components of a single rather than dual design the concept is adaptable to construction of single dwellings and has special advantages in subdivision contruction of single homes.

It is also obvious that not all of the components must be used in each building constructed in accordance with the invention. For example, in a single level design the stairwell 9 would be omitted and the components 3 and 7, if used, rearranged on one level with components 1 and 5 to provide a desired floor plan. Preferably, in any of the many arrangements that can be made, the hollow center walls of the components are aligned or substantially coplanar either horizontally or vertically with each other or with a hollow interior wall (such as 13' which may contain electrical lines for the room it forms) to provide ready space for running of the service lines 83 and to facilitate hook-up of and access to the lines. Many of the advantages may be obtained if only one component, such as dual bathroom 3, is used in each single level dwelling of a multilevel building where such units 3 would be stacked vertically on or above each other with the hollow center walls in alignment and the rest of the floor plan built around the box 3 as a core for each dwelling. Additionally, the boxes may be modified so that, for example, instead of a back-to-back bath there would be provided a back-to-back bath and kitchen with hollow center wall — such tandem modification being especially useful in single family dwellings. It is noted that the hollow central wall is solidly united with horizontal floor elements in these structures as pointed out in U.S. Pat. No. 3,162,863, to form an inverted T load carrying frame for the respective boxes that enables them to be trucked and handled by crane without structural damage.

The construction procedure of this invention has many advantages. While retaining extreme flexibility of design for the architect and developer it incorporates the benefits of mass production. It increases the speed of construction from design or concept to completion. It stabilizes construction costs because the prices of the components are relatively fixed as compared with on-the-site construction. It modifies the types of skills required in given areas so that more of the highly skilled operations are performed in the factory and less at the site. The components are adaptable to various types of buildings, such as hotels, motels, hospitals, commercial buildings, as well as dwellings, thereby increasing the volume of production and lowering the unit cost. The number of local inspections is reduced and inspection at the factory can be more carefully done than on the site. The concept is based on a system approach so that development and research work can focus on entire systems rather than on individual pieces or parts. The components are universally adaptable to individual tastes in wall coverings, floor coverings, colors, etc., and they permit the relatively inexpensive volume areas, such as bedrooms and living rooms, to be flexible as to size and shape to suit each project and inclination. The components can be used with all interior partition systems, ceiling systems, floor systems, exterior facing systems, and other systems used in construction. The number of partitions and walls required is reduced because the outsides of the component box walls serve as partitions or walls for the actual dwelling space can be seen in the drawings. In addition, after the boxes have been fixed in position on the foundation, they can serve as structural elements by attaching gussets to them to support ceilings or floors or using their top surfaces for such support (see box 5 in FIG. 3). The components can be selected with any desired materials or fixtures thereby insuring ready acceptance and adaptability to diverse tastes. Since they are factory built, the components provide for uniform quality and single-source responsibility for the work done. Because of their shape and physical size, which is adapted to regulations affecting the trucking industry, the components can be easily handled so that no unusual installation equipment is required. Because of the fixed costs that can be assigned to the components, financial arrangements for the projects are facilitated. Overall, the components eliminate the duplication of effort that occurs when each piece of material must be individually ordered, delivered, scheduled, and installed by six or more different tradesmen in each room of an on-the-site construction job.

While the boxes of the second levels are shown resting directly on the boxes of the first level it is apparent that they can be spaced vertically apart if desired or required. For example, a second level floor joist system may rest on the first level boxes and the second level boxes, in turn, be set on the joists. In this case they are still supported by the first level boxes. While several levels of boxes can be supported on the lower level, in high rise structures exterior structural framework should intercede to take the load at every few levels. Other modifications in the specific details described may be made without departing from the spirit and scope of the invention.

I claim:

1. The method of constructing a building which comprises building at least portions of a plurality of rooms in a plurality of boxes wherein at least two of said boxes contain internal room structure for two rooms and each has hollow vertical walls separating said two rooms and having utility service lines in said hollow walls, setting the boxes on a foundation so that said hollow walls of said two boxes are substantially aligned and coplanar so that the service lines may cross from one box to another, thereafter erecting walls and ceilings and laying floors with said boxes as a core and with the outer sides of the boxes as part of said walls, and erecting a roof on the building.

* * * * *